US009454134B2

(12) United States Patent
Rochat

(10) Patent No.: US 9,454,134 B2
(45) Date of Patent: Sep. 27, 2016

(54) ASSEMBLY FOR PRODUCING A SOUND FROM A STRIKING MECHANISM

(71) Applicant: BLANCPAIN SA, Le Brassus (CH)

(72) Inventor: Marco Rochat, Le Brassus (CH)

(73) Assignee: BLANCPAIN SA, Le Brassus (CH)

( * ) Notice: Subject to any disclaimer, the term of this patent is extended or adjusted under 35 U.S.C. 154(b) by 0 days.

(21) Appl. No.: 14/699,152

(22) Filed: Apr. 29, 2015

(65) Prior Publication Data

US 2015/0323902 A1 Nov. 12, 2015

(30) Foreign Application Priority Data

May 6, 2014 (EP) ..... 14167093

(51) Int. Cl.
*G04B 21/02* (2006.01)
*G04B 21/08* (2006.01)
*G04B 23/02* (2006.01)

(52) U.S. Cl.
CPC ..... *G04B 21/02* (2013.01); *G04B 21/08* (2013.01); *G04B 23/028* (2013.01)

(58) Field of Classification Search
CPC ..... G04B 21/02; G04B 21/08; G04B 23/028
See application file for complete search history.

(56) References Cited

U.S. PATENT DOCUMENTS 2,786,326 A * 3/1957 Junghans ..... G04B 37/0075 340/391.1
3,225,535 A * 12/1965 Deladerriere ..... G04B 23/028 116/67 R
7,545,706 B2 * 6/2009 Candaux ..... G04B 21/08 368/243
7,742,365 B2 * 6/2010 Moteki ..... G04B 21/06 368/269
8,665,676 B2 * 3/2014 Sarchi ..... G10K 13/00 368/272
2009/0091431 A1 * 4/2009 Chritin ..... G04B 21/08 340/392.2
2011/0051568 A1 * 3/2011 Karapatis ..... G04B 23/026 368/273
2011/0110200 A1 * 5/2011 Goeller ..... G04B 21/08 368/243
2012/0063275 A1 * 3/2012 Favre ..... G04B 23/12 368/243

FOREIGN PATENT DOCUMENTS

| | | |
|---|---|---|
| CH | 702 201 A2 | 5/2011 |
| CH | 705 115 B1 | 12/2012 |
| CH | 707 061 A2 | 4/2014 |
| EP | 2 196 869 B1 | 5/2012 |
| EP | 2 720 091 A1 | 4/2014 |
| FR | 323 408 A | 3/1903 |

OTHER PUBLICATIONS

Machine translation of CH 705115, retrieved from the internet Dec. 28, 2015.*
European Search Report of corresponding EP 14 16 7093 dated Jan. 27, 2015.

* cited by examiner

*Primary Examiner* — Vit W Miska
(74) *Attorney, Agent, or Firm* — Sughrue Mion, PLLC

(57) ABSTRACT

The strike sound producing assembly is provided for a watch striking mechanism. The assembly includes at least one gong, which is directly integral by means of a gong-carrier with an assembly element inside a watch case to form a single piece. A first end of the gong is fixed to the gong-carrier, whereas a second end of the gong is free to move.

12 Claims, 3 Drawing Sheets

ASSEMBLY FOR PRODUCING A SOUND FROM A STRIKING MECHANISM

This application claims priority from European Patent Application No. 14167093.5 filed Jun. 5, 2014, the entire disclosure of which is incorporated herein by reference.

FIELD OF THE INVENTION

The invention concerns an assembly for producing a strike sound to be fitted to a watch provided with a timepiece movement including a striking mechanism.

The invention also concerns a watch, which includes a watch case with a middle part, a back cover and a crystal defining a housing for a timepiece movement including a striking mechanism provided with an assembly for producing a strike sound.

The invention also concerns a method of manufacturing an assembly for producing a strike sound.

BACKGROUND OF THE INVENTION

In the field of horology, a timepiece movement inside a watch case may be provided with a striking mechanism in a conventional architecture. Such a striking mechanism generally includes a gong fixed at one of its ends to a gong-carrier, which is in turn integral with a watch plate carrying the movement, and a hammer for striking the gong at determined moments. This striking mechanism is used, in particular, for minute-repeaters or for an alarm. The gong may be a metal wire of circular shape, which may be disposed around the timepiece movement.

A conventional striking mechanism is formed of individual elements, which are intended to be assembled one after the other on the watch plate. The assembly of the striking mechanism can generally take a long time to achieve, which is a drawback. Further, the elements forming the striking mechanism have to be manufactured independently of each other. Account must also be taken of the configuration of at least one gong of the striking mechanism, which should optimise the efficiency of the watch striking mechanism to transmit vibrations more efficiently in combination with the various other elements of the watch. Improved propagation of vibrations from the gong to the external parts, such as the watch case, is desired, but difficult to achieve with a conventional striking mechanism.

EP Patent No 2 196 869 B1, which discloses a watch case with a striking mechanism, may be cited in this regard. The gong and gong-carrier of the striking mechanism are made at the same time as the middle part and/or the back cover of the watch case. The gong and gong-carrier are integral either with the middle part, or the back cover to form one piece with the middle part or the back cover of the watch case.

However, one drawback of such an embodiment is that the gong is related to the manufacture of the watch case, which is consequently complex and expensive. It is therefore not possible to select the material forming the gong without taking account of the material of the watch case. When it is desired to change the gong to modify the strike sound of the striking mechanism or due to breakage or an observed defect, one part of the watch case must also be changed, which is a drawback.

SUMMARY OF THE INVENTION

It is therefore an object of the invention to overcome the drawbacks of the state of the art by providing an assembly for producing a strike sound from a striking mechanism that is easy to make and able to produce a rich sound with improved vibration propagation once mounted in a watch case.

To this end, the invention concerns an assembly for producing a strike sound from an aforecited striking mechanism, wherein the assembly includes at least one gong, which is integral by means of a gong-carrier to an assembly element to form a single piece, the assembly element being used to mount the assembly inside a watch case.

Specific embodiments of the assembly for producing a strike sound are defined in the dependent claims 2 to 7.

One advantage of the assembly for producing a strike sound lies in the fact that the gong and gong-carrier are made at the same time as an element for assembly in a watch case to form only one piece. This simplifies the manufacture of a gong, fixed at at least one end to a gong-carrier, and of the assembly element, which also serves to hold the gong-carrier with the gong inside the watch case. Thus, the material forming the one-piece gong/assembly element can be selected irrespective of the material that forms the watch case. Further, since the gong-carrier and gong are made at the same time in the same preform as the assembly element, this avoids an additional operation of assembling the gong on the gong-carrier.

Advantageously, the assembly element is made in the form of a band or ring, such as a casing ring. This ring, which carries the gong-carrier and the gong, may be assembled driven into the watch case, particularly in the middle part of the watch case. The assembly is thus held inside the watch case while leaving the gong free to vibrate. Improved vibration transmission from the gong to the watch case is thus obtained, which increases the perceived strike sound volume.

To this end, the invention also concerns a watch, including a watch case with a middle part, a back cover and a crystal defining a housing for a timepiece movement with a striking mechanism, wherein the striking mechanism includes a strike sound producing assembly.

Specific embodiments of the watch are defined in the dependent claims 9 and 10.

To this end, the invention therefore also concerns a method for manufacturing a strike sound producing assembly, wherein a single piece is formed with at least one gong connected to an assembly element via a gong-carrier after an operation of stamping a preform or of moulding the piece in a mould, the assembly element being used to mount the assembly inside a watch case.

Specific manufacturing steps are defined in the dependent claims 12 and 13.

One advantage of the method for manufacturing an assembly for producing a strike sound according to the invention lies in the fact that a single part, which includes the assembly element, the gong and its gong-carrier, is formed after one machining operation, such as a stamping or moulding operation.

BRIEF DESCRIPTION OF THE DRAWINGS

The objects, advantages and features of the assembly for producing a strike sound from a watch striking mechanism and the method for manufacturing the assembly will appear more clearly in the following description in particular with reference to the drawings, in which.

DETAILED DESCRIPTION OF THE INVENTION

In the following description, all the parts of a watch striking mechanism that includes an assembly for producing a strike sound via a gong struck by a hammer, which are well known in this technical field, will be described only briefly.

Figure 1A:
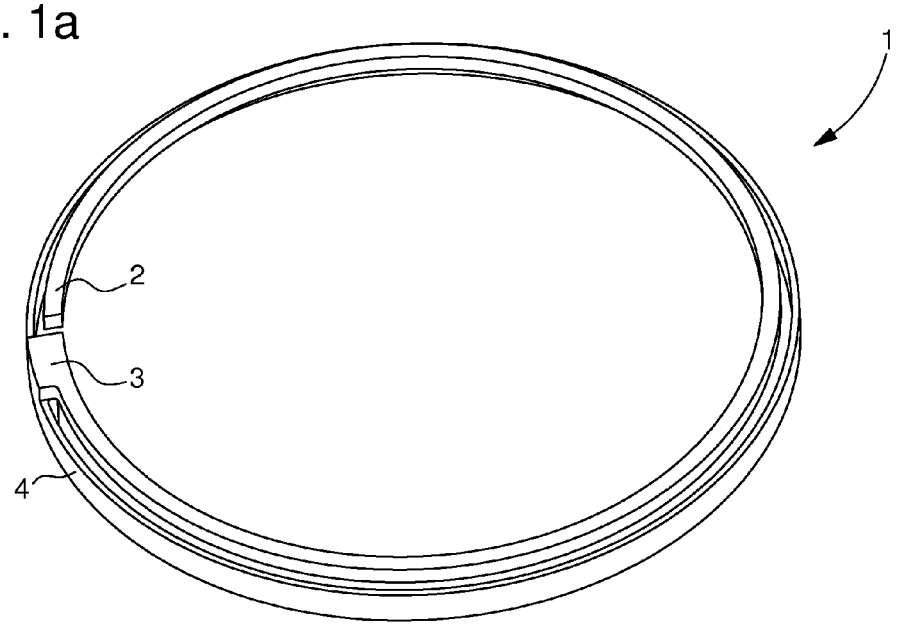
FIGS. 1*a* and 1*b* show a three dimensional top view and a top plan view of a first embodiment of the assembly for producing a strike sound from a striking mechanism according to the invention.
Figure 1B:
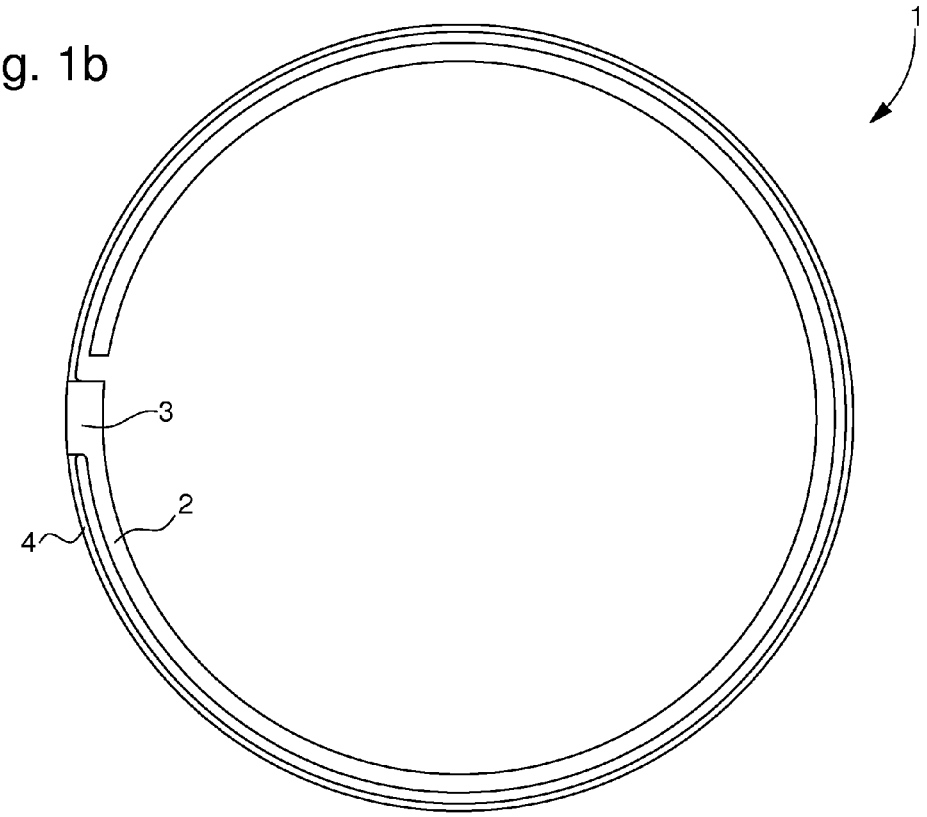

FIGS. 1*a* and 1*b* show a first embodiment of an assembly 1 for producing a strike sound from a striking mechanism. This assembly is formed of at least one gong 2, which is fixed at one of its ends to a gong-carrier 3, and of an assembly element 4, which is directly fixed to gong-carrier 3. The other end of gong 2 is free to move. The assembly element can be directly mounted, especially driven into a complementary portion of the watch case, such as the middle part of the watch case.

According to FIGS. 1*a* and 1*b*, gong 2 is disposed slightly above and parallel to assembly element 4 while being connected by gong-carrier 3 to the assembly element. However, the gong may also be disposed in the same plane as the assembly element while being connected to assembly element 4 by gong-carrier 3. Further, it may also be provided that the two ends of gong 2 are fixed to two opposite sides of gong-carrier 3.

Assembly element 4 of the mechanical timepiece movement is preferably made in the form of a band or ring. This ring may, for example, be a casing ring, which is intended to be assembled driven into the watch case, as shown schematically in FIGS. 3*a* and 3*b*. However, the casing ring may also be fixed in another manner inside said watch case. The band or ring 4 may be mounted on a watch plate, on which the mechanical timepiece movement is also mounted. Preferably, the lower portion of casing ring 4 is mounted on the plate, whereas gong 2 is disposed on the side of the upper portion of casing ring 4.

Gong 2, which is parallel to casing ring 4, may be of circular shape and coaxial to said casing ring 4. The outer diameter of gong 2 may be slightly smaller than the inner diameter of casing ring 4. Gong 2 may be configured to surround one portion of the timepiece movement on the watch plate. The gong may be struck by a hammer of the striking mechanism, which also forms part of the timepiece movement. Gong 2 extends in a parallel plane to said main plate. The metal wire of gong 2 may define a portion of a circle with an angle, for example, of between 180° or less and 360°, but preferably close to 330°.

Gong 2, gong-carrier 3 and assembly element 4 can be made of a material which is preferably metallic or of metallic glass. The material may be selected to be a metallic material, such as steel, or a precious metal, such as gold, platinum or silver, or a precious metal alloy. The cross-section of the gong may be circular, with a diameter of less than 1 mm, for example around 0.6 mm. However, this cross-section of each gong may also preferably be rectangular, which may make it easier to make, as explained below.

If the material of gong 2 is selected from among precious metals, in particular gold, it is possible to produce a chime sound, with a single winding of metal wire in the watch case. Acoustic intensity is improved due to the increased transmission coefficient to the external parts of the watch, located downstream of the gong. This therefore provides improved vibration propagation from gong 2 to the radiating parts of the watch.

The method of manufacturing assembly 1 for producing a strike sound can now be described. At least one gong 2 connected to a gong-carrier 3 may be made with assembly element 4 in the same preform. To achieve this and depending on the type of material used or on the shape to be obtained, an operation of stamping a preform of the assembly, or a moulding operation can be performed first of all.

In the case of a preform stamping operation, the part formed, which includes gong 2 connected by gong-carrier 3 to assembly element 4, can be obtained in a single step in a stamping machine die. However, it may be preferred that a free end of the gong is held by at least one bridge of material to the assembly element, and that the stamping operation is followed by at least one milling operation in a machine tool to release the end of said gong 2 and possibly to tune said gong. However, if the two ends of the gong have to be connected to two opposite sides of the gong-carrier, a single stamping operation may be sufficient.

In the case of a moulding operation in a mould with at least two parts, the metal or metallic glass in molten state is introduced into said mould, followed by a cooling operation. Assembly 1, which includes at least one gong 2, connected via gong-carrier 3 to assembly element 4, can thus be obtained immediately after removal from the mould. Gong 2 is produced directly with two ends fixed to gong-carrier 3 or with one end fixed to the gong-carrier and one free end after only one moulding step. The cross-section of each gong may be circular or equally rectangular with this moulding operation. However, a milling operation may also be subsequently performed in order to tune gong 2.

Figure 2A:
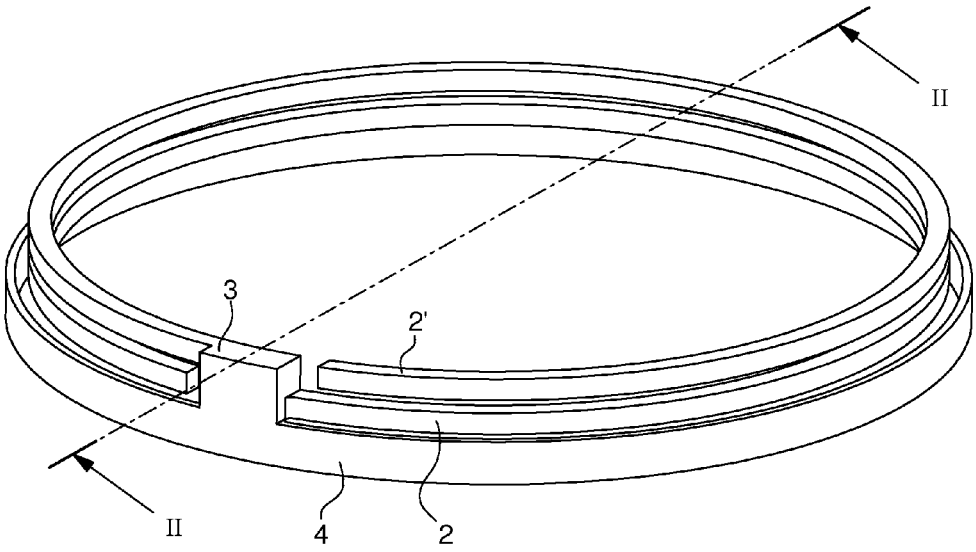
FIGS. 2*a* and 2*b* show a three dimensional top view and a cross-sectional view along II-II of FIG. 2*a* of a second embodiment of the assembly for producing a strike sound from a striking mechanism according to the invention.
Figure 2B:
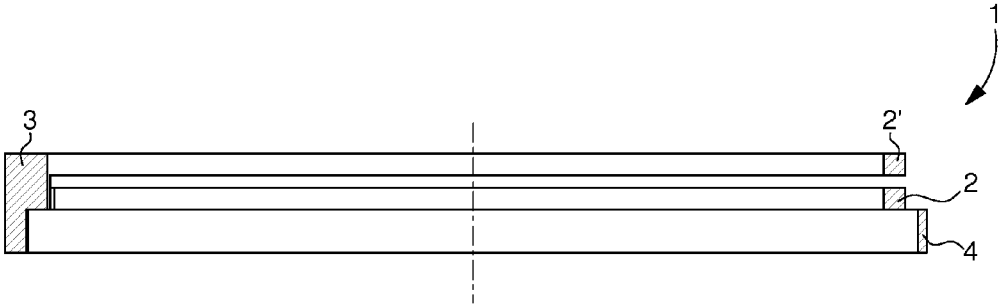

FIGS. 2*a* and 2*b* show a second embodiment of an assembly 1 for producing a strike sound from a striking mechanism. This assembly is formed of a first gong 2 and of a second gong 2', which are fixed at at least one of their ends to the same gong-carrier 3, and of an assembly element 4, which is directly connected to gong-carrier 3. Each other end of first gong 2 and of second gong 2' is free to move. The material used for assembly 1 is identical to the material described with reference to the first embodiment.

According to FIGS. 2*a* and 2*b*, gongs 2 and 2' may be disposed slightly above and parallel to assembly element 4 while being connected by gong-carrier 3 to the assembly element. Second gong 2' is superposed on first gong 2, each being disposed parallel and coaxial to assembly element 4. The two gongs 2, 2' also have no contact with each other, in order each to be struck by a respective hammer of the striking mechanism.

As in the first embodiment, assembly element 4 of the mechanical timepiece movement may be a band or a ring, such as a casing ring. The band or ring 4 is intended to be mounted driven into a portion of complementary shape of the watch case, particularly in the case middle. However, the casing ring may also be fixed in another manner inside said watch case. Casing ring 4 may be mounted on a watch plate.

The lower portion of casing ring 4 may be mounted on the plate, whereas gongs 2, 2' are disposed on the upper portion side of casing ring 4.

The first and second gongs 2 and 2' may thus be of circular shape with an identical outer diameter, but which may be smaller than the inner diameter of casing ring 4. The metal wire of each gong 2, 2' may define a portion of a circle with an angle, for example, of between 180° or less and 360°, but preferably close to 330°. The portion of a circle of first gong 2 may have a different angle from the angle of the portion of a circle of second gong 2'. Each gong may have an identical cross-section over the entire length thereof or a non-constant cross-section over the length thereof. The cross-section of first gong 2 may also be different from the cross-section of second gong 2'. One end of first gong 2 is fixed on one side of gong-carrier 3, whereas one end of second gong 2' is fixed on an opposite side of the same gong-carrier 3.

The method of manufacturing strike sound producing assembly 1 of the second embodiment includes identical manufacturing steps to the method described with reference to the first embodiment of the assembly. For the second embodiment of assembly 1, a first gong 2 and a second gong 2', which are from the same gong-carrier 3, may be made with assembly element 4 in a preform. A machining operation, such as an operation of stamping a preform of the assembly, or a moulding operation, may be performed.

If it is intended to make two gongs 2 and 2' which have at least one end connected to the same gong-carrier 3, a bridge of material normally connects the free ends of the two gongs to the inner portion of assembly element 4 or to the other gong. In such case, at least one milling or cutting operation must be performed in a machine tool after the preform is stamped in order to separate the two gongs and their link to assembly element 4. However, if both ends of gongs 2, 2' must be fixed to gong-carrier 3, only the stamping operation is performed. The cross-section of each gong may preferably be rectangular after the stamping operation.

Figure 3A:
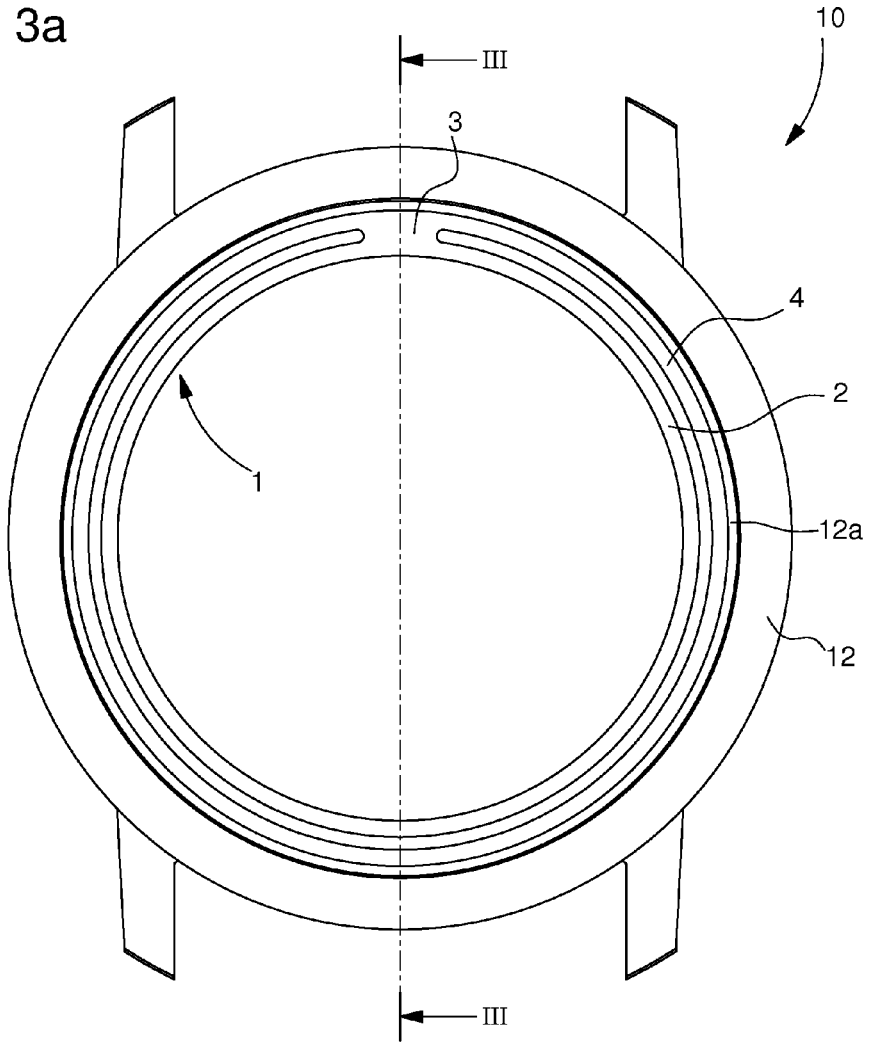
FIGS. 3*a* and 3*b* show schematically a top plan view and a cross-sectional view along III-III of FIG. 3*a* of a watch, in which is arranged the assembly for producing a strike sound from the striking mechanism according to the invention.
Figure 3B:
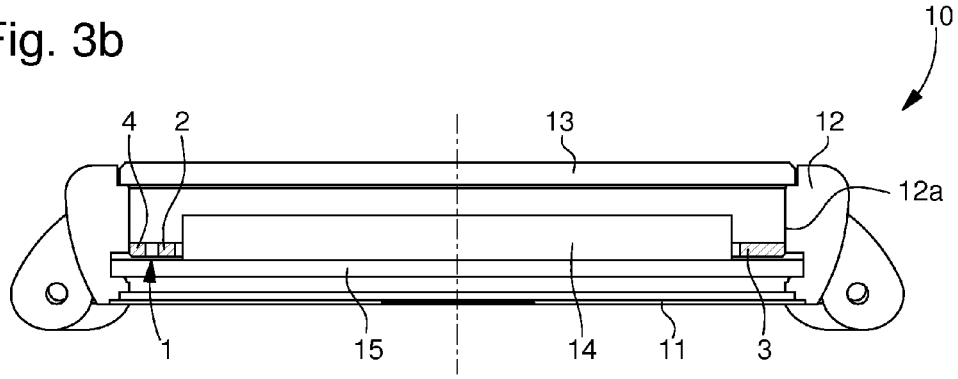

FIGS. 3*a* and 3*b* are a partial top plan view and a simplified diametral sectional view of a watch 10, which includes a striking mechanism. Said striking mechanism includes one portion in a timepiece movement 14, disposed on a plate 15, and another portion formed by assembly 1 for producing a strike sound. The portion of the striking mechanism included in timepiece movement 14 is formed, in particular, of at least one hammer driven by a drive spring for striking the gong at determined moments.

Watch 10 also includes a watch case, which is formed in a conventional manner by a back cover 11 fixed to a lower portion of a case middle 12 and a watch crystal 13, which is mounted on an upper portion of case middle 12 to close the watch case. Plate 15 is fixed to case middle 12, but may also be secured between back cover 11 and case middle 12 with the insertion of a sealing gasket (not shown). Timepiece movement 14 with one portion of the timepiece mechanism is mounted on said plate 15 in a housing defined by back cover 11, case middle 12 and crystal 13. Although not shown, watch 10 also includes a dial above timepiece movement 14 and hands for indicating the time on the dial which are connected by at least one arbor to the timepiece movement.

Strike sound producing assembly 1 is preferably assembled by being driven into a complementary portion 12*a* of the watch case, such as middle part 12 of the watch case. Assembly element 4 is thus held by friction against inner wall 12*a* of middle part 12 with no need for other securing components. This assembly element 4 may also bear on plate 15.

In the embodiment of FIGS. 3*a* and 3*b*, gong 2 is of circular shape like assembly element 4, and includes two ends fixed directly to gong-carrier 3. Gong 2 is disposed coaxially to assembly element 4 and in the same plane with no contact with assembly element 4. As assembly element 4 is secured by being driven into the inner wall 12*a* of middle part 12, this facilitates the assembly of strike sound producing assembly 1 and provides improved vibration propagation from the vibrating gong 2 to the external parts such as watch case 10.

From the description that has just been given, several variants of the assembly for producing a strike sound from a striking mechanism can be devised by those skilled in the art without departing from the scope of the invention defined by the claims. Several gongs may be provided, fixed to the same gong-carrier or to several gong-carriers arranged on the periphery of the assembly element. Each gong may have a different length and cross-section from every other gong to each define a particular sound during vibration. The gong or gongs may have a shape other than a circle, for example a generally rectangular or polygonal shape, or describe a corkscrew shape around the watch movement. The assembly element may be disposed on an inner side of the gong or gongs. There may be provided at least one gong, disposed on an inner side of the assembly element and at least one other gong, disposed on an outer side of the assembly element in the same plane or not in the same plane as the assembly element. The strike sound producing element may be achieved by a machining operation, such as by laser or waterjet cutting, or milling.

What is claimed is:

1. An assembly for producing a strike sound from a watch striking mechanism, wherein the assembly comprises:

an assembly element;

at least one gong; and a gong-carrier that integrally attaches the at least one gong to the assembly element such that the assembly element, the at least one gong and the gong-carrier are a single, unitary piece, the assembly element being configured to mount the assembly inside a watch case, wherein the assembly element has a shape corresponding to one of circular, rectangular and polygonal and is configured to be press-fit-into a portion of the watch case having complementary shape.

2. The strike sound producing assembly according to claim 1, wherein the material used to make the assembly includes gold, platinum, or a precious metal alloy.

3. The strike sound producing assembly according to claim 1, wherein the gong is held via one of the ends thereof to the gong-carrier, whereas the other end is free to move, one portion of said gong defining a portion of a circle with an angle of between 180° and 360° to be disposed around a movement of the watch inside a watch case.

4. The strike sound producing assembly according to claim 1, wherein the assembly includes two gongs from the same gong-carrier.

5. The strike sound producing assembly according to claim 4, wherein one end of the first gong and one end of the second gong are each connected on two opposite sides of the gong-carrier, whereas the other end of each gong is free to move, and wherein each gong defines a portion of a circle with an angle of between 180° and 360° to be disposed around a movement of the watch inside a watch case.

6. The strike sound producing assembly according to claim 4, wherein the two gongs are arranged coaxially superposed inside the watch case without any contact with each other.

7. A watch including a watch case with a middle part, a back cover and a crystal defining a housing for a timepiece movement with a striking mechanism, wherein the striking mechanism includes a strike sound producing assembly according to claim 1.

8. The watch according to claim 7, wherein the strike sound producing assembly is mounted driven into the watch case to optimise the acoustic radiation of at least one vibrating gong of the strike sound producing assembly.

9. The watch according to claim 8, wherein the assembly element is mounted driven against an inner wall of a middle part of the watch case.

10. A method for manufacturing a strike sound producing assembly according to claim 1, wherein a single piece is formed with at least one gong connected to an assembly element via a gong-carrier after an operation of stamping a preform or of moulding the piece in a mould, the assembly element being used to mount the assembly inside a portion of complementary shape of a watch case, the assembly element being of one of a circular, rectangular and polygonal shape.

11. The method for manufacturing a strike sound producing assembly according to claim 10, wherein the method includes the steps of:

stamping a preform of the assembly to obtain the assembly element, the gong-carrier, and one or two gongs, wherein one end of each gong is connected to the same gong-carrier, whereas at least the other end of each gong is connected by a bridge of material in an inner portion of the assembly element, and milling or cutting at least the bridge of material holding each gong to release the other end thereof.

12. The method for manufacturing a strike sound producing assembly according to claim 11, wherein a subsequent milling operation is performed to tune each gong.

* * * * *